US007395773B1

(12) United States Patent
Finefield

(10) Patent No.: US 7,395,773 B1
(45) Date of Patent: Jul. 8, 2008

(54) MULTI-PART BOAT

(76) Inventor: Kenneth Finefield, 722 S. Orange Ave., Santa Ana, CA (US) 92701

( * ) Notice: Subject to any disclaimer, the term of this patent is extended or adjusted under 35 U.S.C. 154(b) by 0 days.

(21) Appl. No.: 11/749,089

(22) Filed: May 15, 2007

(51) Int. Cl.
*B63B 7/04* (2006.01)
*B63B 3/08* (2006.01)

(52) U.S. Cl. ..... 114/352

(58) Field of Classification Search ..... 114/77 R, 114/77 A, 352–354
See application file for complete search history.

(56) References Cited

U.S. PATENT DOCUMENTS

| | | | | | |
|---|---|---|---|---|---|
| 1,449,222 | A | | 3/1923 | Goethel | |
| 2,584,685 | A | * | 2/1952 | Evert | 114/352 |
| 3,090,973 | A | * | 5/1963 | Levinson | 114/344 |
| 3,614,938 | A | * | 10/1971 | Statile | 114/248 |
| 3,822,427 | A | * | 7/1974 | Ewart, Jr. | 114/352 |
| 3,916,468 | A | | 11/1975 | Tetreault et al. | |
| D259,927 | S | * | 7/1981 | Norlund | D12/310 |
| 4,718,587 | A | * | 1/1988 | Roberts | 224/328 |
| 4,790,256 | A | * | 12/1988 | Levine | 114/352 |
| 5,261,346 | A | * | 11/1993 | Updyke | 114/352 |
| 5,301,629 | A | * | 4/1994 | Kleyh et al. | 114/352 |
| 5,349,918 | A | * | 9/1994 | Elie | 114/352 |

FOREIGN PATENT DOCUMENTS

| | | | |
|---|---|---|---|
| AU | 2004100379 | A4 * | 6/2004 |
| GB | 2090563 | A * | 7/1982 |
| WO | WO 2004089737 | A1 * | 10/2004 |

* cited by examiner

*Primary Examiner*—Ajay Vasudeva
(74) *Attorney, Agent, or Firm*—QuickPatents, Inc.; Kevin Prince

(57) ABSTRACT

A multi-part boat includes a plurality of substantially hollow hull sections with at least one end of each section being attachable to one end of another section, with at least one bulkhead attachment means comprising a groove portion and a tongue portion. Hull sections include a bow section, a middle section, and a stern section. The bow section and the stern section can at least partially fit within the middle section when the boat is in a disassembled configuration. The bottom side of the hull sections includes a keel that partially overlaps an adjacent hull section and include a cooperating keel that is shorter than the length of the bottom side thereof by the amount of overlap of the keel. The tongue portion includes a locking means which further includes a tapered shim for frictionally locking the tongue portion to the groove portion. The tapered shim further includes an elongated aperture and a handle whereby the handle can be pivoted between a locked and an unlocked position.

4 Claims, 14 Drawing Sheets

MULTI-PART BOAT

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to boats, and more particularly to an easily-assembled multi-part boat.

DISCUSSION OF RELATED ART

Lightweight boats well designed for smooth use in water are often difficult to transport by vehicle, particularly due to their length. Multi-part boats which are generally comprised of multiple individual boat sections, are often characterized in such a way that the boat sections are hinged together to fold over on each other. The individual boat sections can nest inside each other for easy storage. The individual boat sections are formed such that they are identical in structure but vary in size for easy nesting. When assembled, the boat has an irregular shape wherein it angles outward from a narrow point at one end to a wide point at the opposite end. This design makes an awkward boat shape that is entirely restricted by the dimensions of the largest section.

A variety of attachment mechanisms or locking means can be provided to connect the plurality of sections to form a rigid boat structure. Problems exist in locking the hull sections in the open operative positions. The hull sections must be positively locked in the open condition or wave action will cause the halves to swing together and apart, resulting in dangerous instability. One prior art method includes a multi-part boat, which comes apart in multiple sections that further fold along a centerline. The sections nest inside one another to form a more compact unit for storage. However, the boat does not provide for multiple points of connection between the sections to provide for a secure vessel. The sectional boats of the prior art are generally provided with complex means of connection between the segments that often require multiple parts, the use of additional tools for assembly, as well as special or precision manufacturing techniques to produce the boat sections.

Therefore there is a need for safely functioning, aesthetically appealing, compact and easily transportable multi-part boat, which can be easily assembled and disassembled, and wherein the sections of the boat will nest inside each other for compact storage and easy portability. There is also a need for multi-part boat and locking arrangement which can be easily manufactured and assembled by the user without complicated attachment mechanisms or additional tools to provide for a secure rigid boat structure. The present invention accomplishes these objectives.

SUMMARY OF THE INVENTION

The present invention includes independent segments that connect together to form a rigid boat of regular construction that will glide easily through water, and will disassemble to several differently sized segments that nest together for easy storage and portability. The multi-part boat of the present invention includes a plurality of substantially hollow hull sections, including a bow section, a stern section and a middle section, each section having at least one bulkhead side, at least one peripheral side, a bottom side, and a top side. At least one bulkhead attachment means further provides a groove portion and a tongue portion each dovetail in shape.

One of the tongue portions includes a locking means further including a tapered shim for frictionally locking the tongue portion to the groove portion. At least one of the hull sections including a keel on the bottom side thereof that partially overlaps an adjacent hull section which includes a cooperating keel that is shorter than the length of the bottom side. When the two hull sections are fixed together by the bulkhead attachment means the keel of the one hull section becomes co-aligned and abutted with the keel of the adjacent hull section. The tapered shim further includes an elongated aperture and is slidably held along a substantially vertical plane by a bolt means to one tongue portion, and a handle is pivotally fixed to the one tongue portion at a pivoted end thereof.

The handle may be pivoted between a locked and an unlocked position, the locked position forcing the shim between one of the tongue and groove portions for frictionally locking the tongue portion to the groove portion. The handle is pivotally fixed to the top portion of the shim by a connector that includes an elongated, substantially horizontal slot for receiving a locking pin of the handle and a threaded aperture on the lower side of the connector adapted for receiving a threaded shaft. The bow section and the stern section can at least partially fit within the middle section when the boat is in a disassembled configuration. The groove portion and the tongue portion further include a rigid reinforcing bracket.

The present invention is a safely functioning, aesthetically appealing, compact and easily transportable multi-part boat, which is easily assembled and disassembled within a minute, and wherein the sections of the boat nest inside each other for compact storage and easy portability. The present device includes a locking arrangement which can be easily manufactured and assembled by the user without complicated attachment mechanisms or additional tools, resulting in a secure rigid boat structure. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
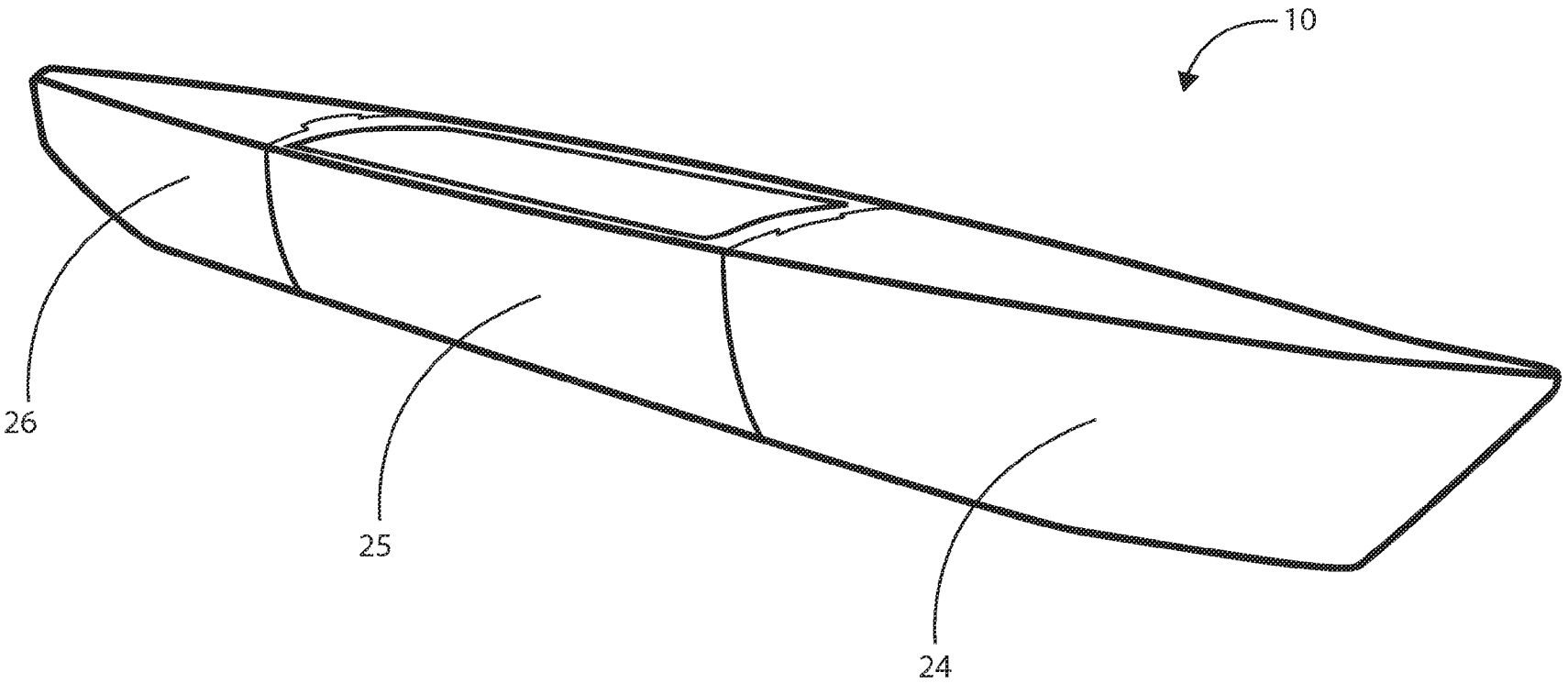
FIG. 1 is an exploded perspective view of the invention, illustrating a multi-part boat including a bow section, a middle section and a stern section in an assembled configuration.
Figure 2:
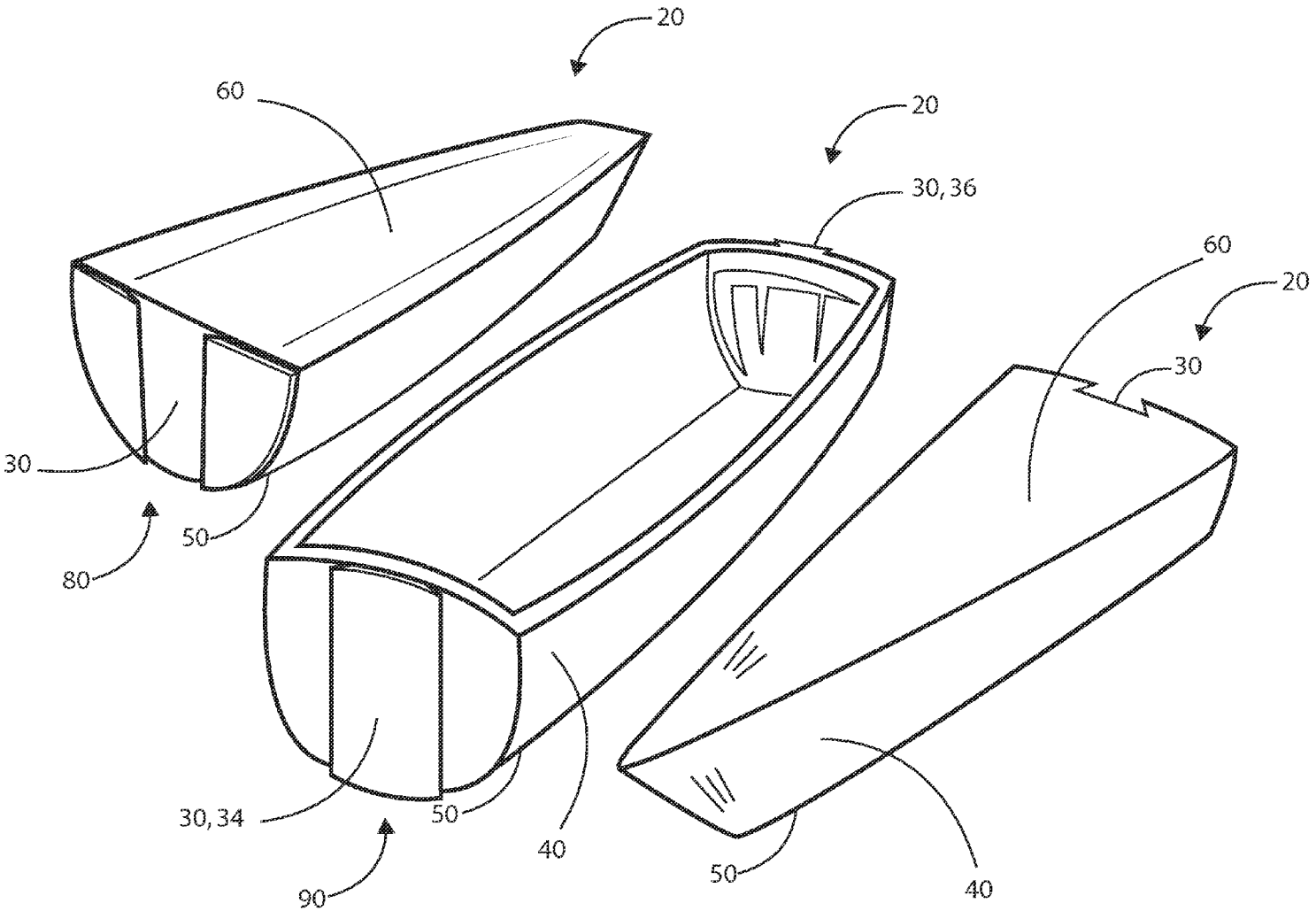
FIG. 2 is a perspective view of the invention, illustrating a multi-part boat comprising multiple hull sections in a disassembled configuration.

Referring to FIG. 1, illustrated is a multi-part boat 10 formed of a bow section 24, a middle section 25 and a stern section 26. Referring to FIG. 2, the boat 10 is shown disassembled and wherein it further includes a plurality of substantially hollow hull sections 20. Each hull section 20 has at least one bulkhead side 30, at least one peripheral side 40, a bottom side 50, and a top side 60. The middle section 25 further includes a forward bulkhead side 34 adapted for attaching to the bow section 24, and a rear bulkhead side 36 for attaching to the stern section 26. The middle section 25 has a substantially open top side 60.

Figure 3:
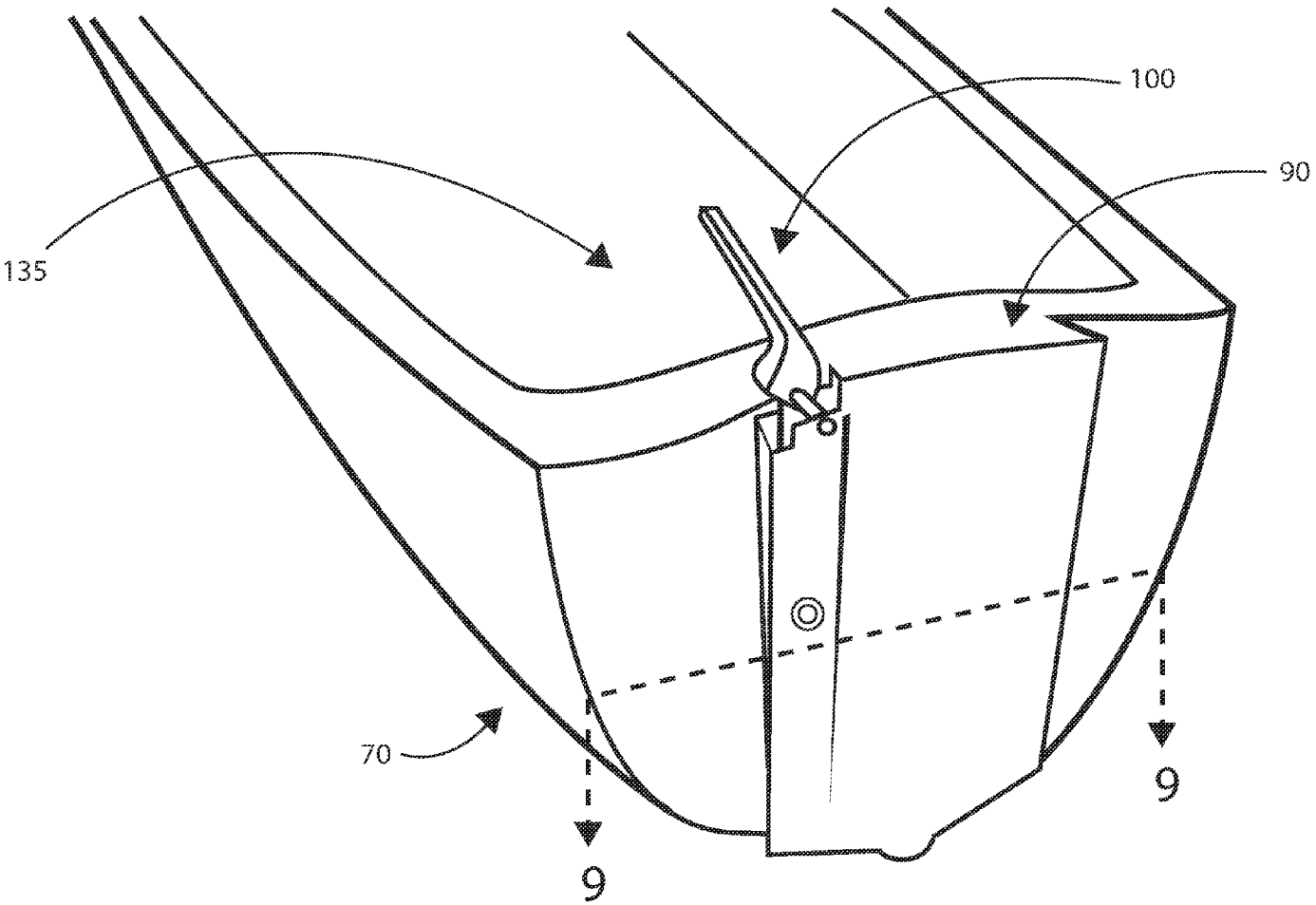
FIG. 3 is a rear edge view of the middle section of the multi-part boat illustrating a tongue portion and a locking means located on its outer end for locking the end of another hull section.
Figure 9:
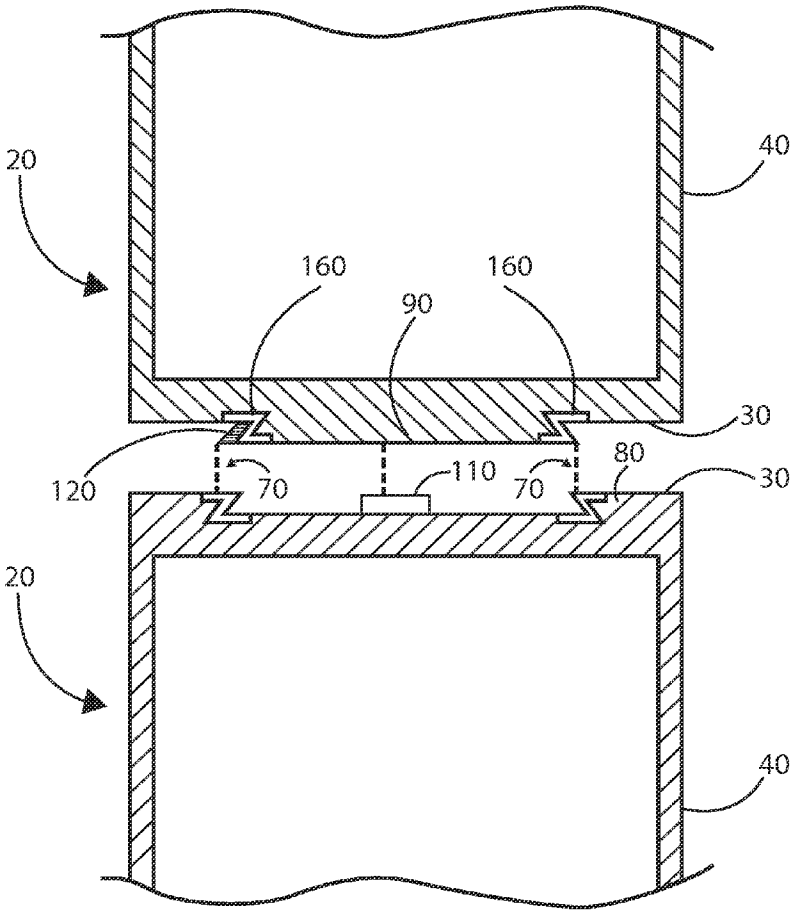
FIG. 9 is a perspective view of the invention, illustrating the tongue portion and a groove portion of complimentary hull sections with a reinforcing bracket.

Referring to FIG. 3, the multi-part boat 10 also includes at least one bulkhead attachment means 70. Referring to FIG. 9, hull sections 20 of the multi-part boat 10 include a groove portion 80 associated with one hull section 20 and a tongue portion 90 associated with the other hull section 20 in order for the hull sections 20 to interconnect. Each tongue portion 90 is used for slidable mutual engagement to one of the groove portions 80, each portion fixed to one of the at least one bulkhead sides 30 of one of the hull sections 20. Referring again to FIG. 3, one of the tongue portions 90 further includes a locking means 100 for selectively locking each tongue portion 90 to the groove portion 80 once engaged with each other. Full engagement of each hull sections 20 is accomplished when each tongue portion 90 of one of the plurality of hull sections 20 are slidably engaging to one of the groove portions 80 of one of the other hull sections 20 and the hull sections 2 are locked together with the locking means 100 thereof.

Figure 4:
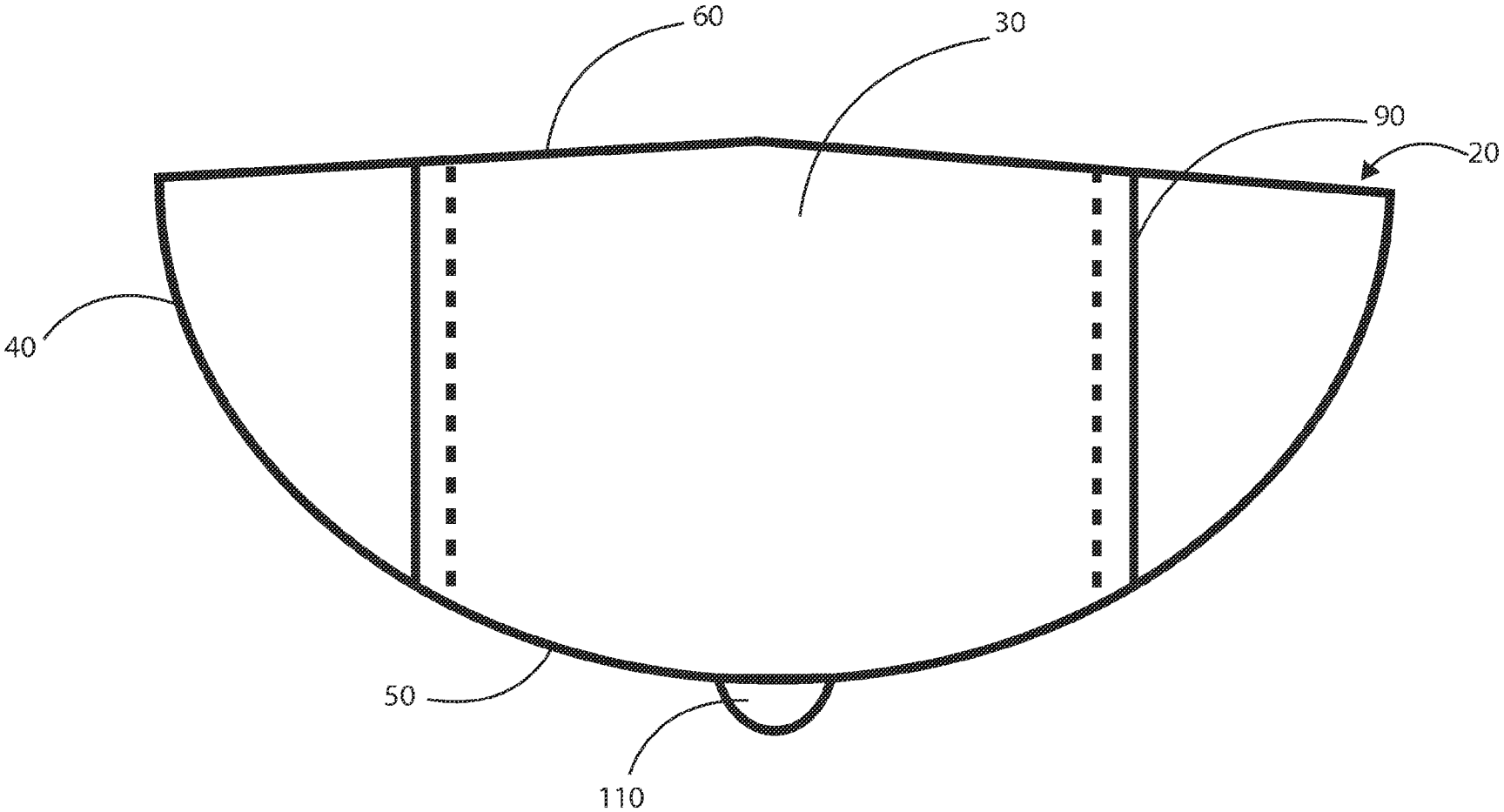
FIG. 4 is a cross-sectional view of the invention, taken generally along lines 9-9 of FIG. 3, and illustrating a keel on the bottom side of the hull section.

Referring to FIG. 4, a cross-sectional view of the invention, taken generally along lines 9-9 of FIG. 3, is illustrated. As shown in FIG. 4, a keel 110 is located on the bottom side 50 of each hull section 20. Each hull section 20 includes a keel 110 on the bottom side 50 thereof that partially overlaps an adjacent hull section 20 when the two hull sections 20 are fixed together by the bulkhead attachment means 70, such that the keel 110 acts as a stop for preventing slidable engagement of the two hull sections 20 beyond a point of proper coaxial alignment thereof. Clearly an alternate stop means (not shown) could be included on the top sides 60 of each hull section 20.

Figure 5:
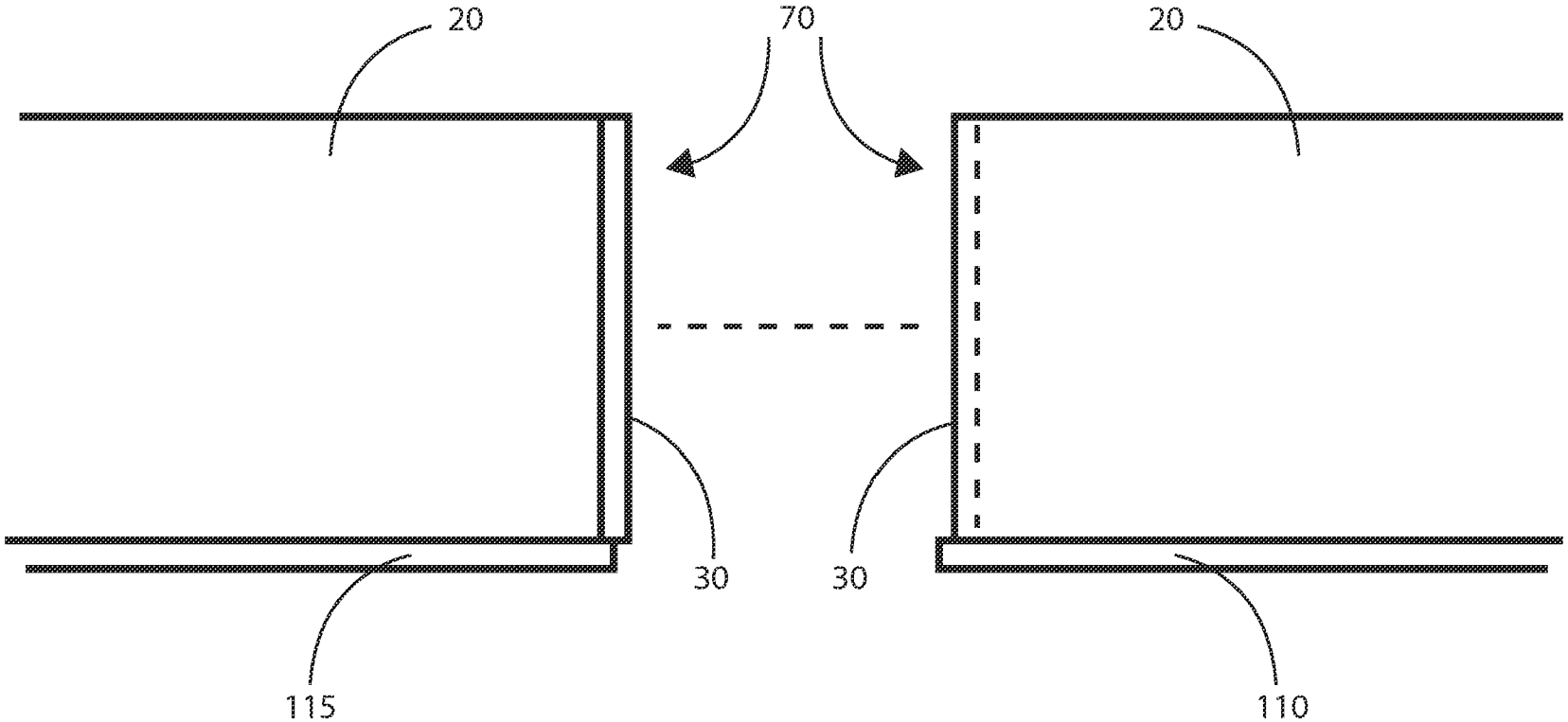
FIG. 5 is a side view of two complimentary sections of a multi-part boat, further illustrating the keel and a co-operating keel on the bottom side of the hull sections for connecting the hull sections.

Referring to FIG. 5, a side view of two hull sections 20 of the multi-part boat 10, further illustrating the keel 110 and a cooperating keel 115 on the bottom side 50 of the hull sections 20 for connecting the hull sections 20 is shown. One adjacent hull section 20 further includes cooperating keel 110 that is shorter than the length of the bottom side 50 thereof by the amount of overlap of the keel 110 of one hull section 20. As such when the two hull sections 20 are fixed together by the bulkhead attachment means 70 the keel 110 of one hull section 20 becomes co-aligned and abutted with the co-operating keel 115 of the adjacent hull section 20 thereof.

Figure 7:
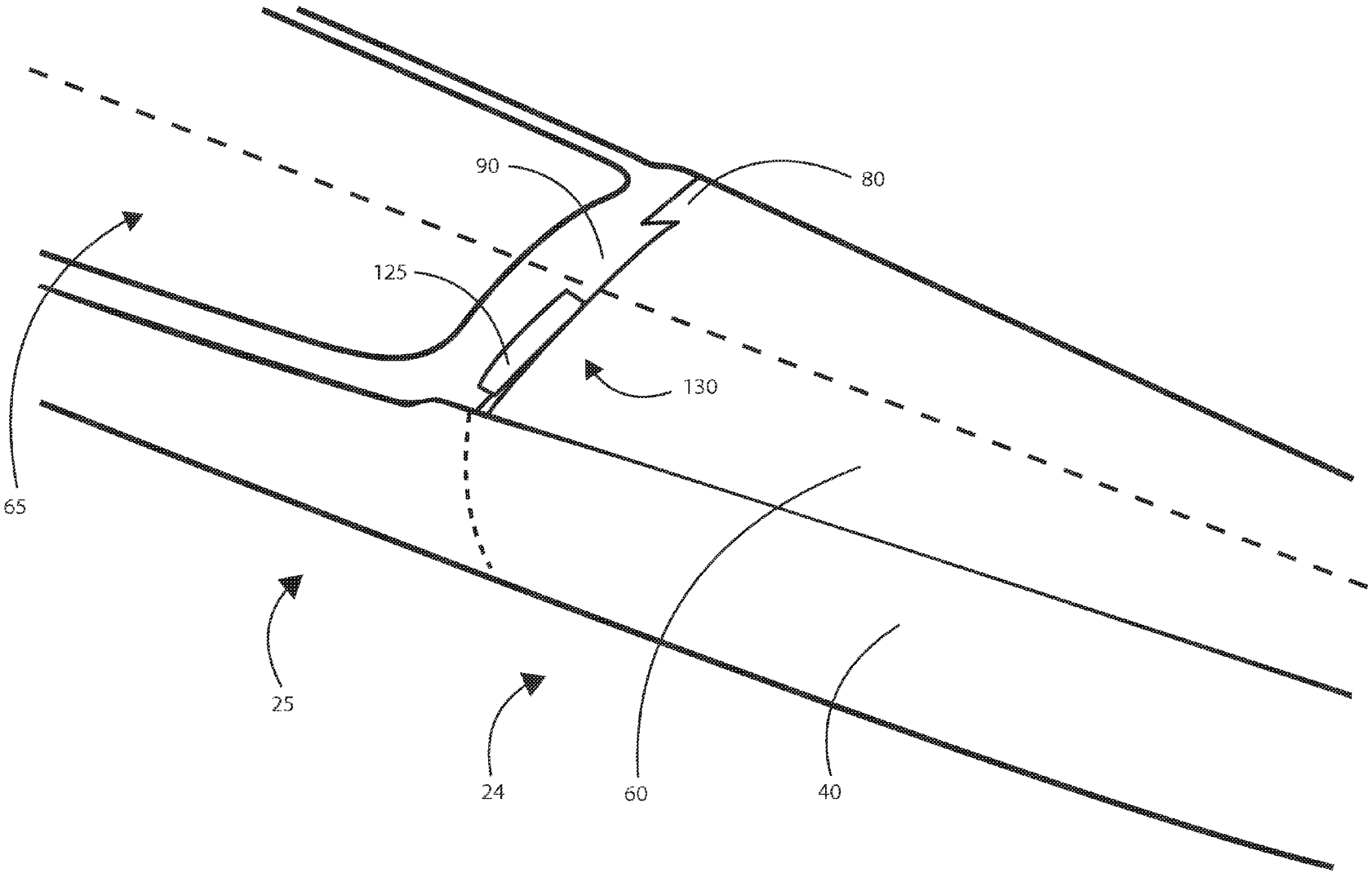
FIG. 7 is a perspective view of the invention, illustrating the middle section being locked to the bow section using a locking means.

Referring to FIGS. 7 and 9, the groove portion 80 and the tongue portion 90 of respective hull sections 20 are each dovetail in shape and therefore complimentary; however, lateral movement of each hull section 20 with respect to the other hull sections 20 is prevented.

Figure 6A:
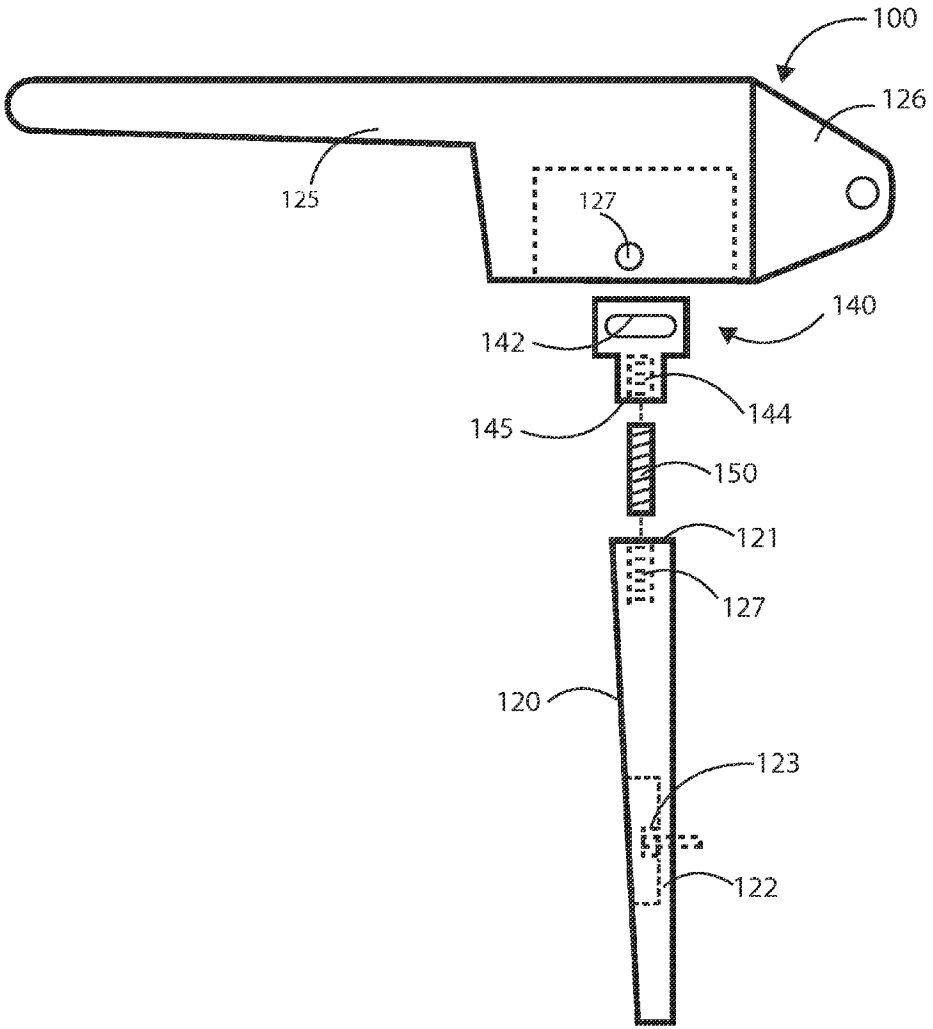
FIG. 6A is an exploded view of the invention, illustrating the locking means with a handle attached to a tapered shim.
Figure 6B:
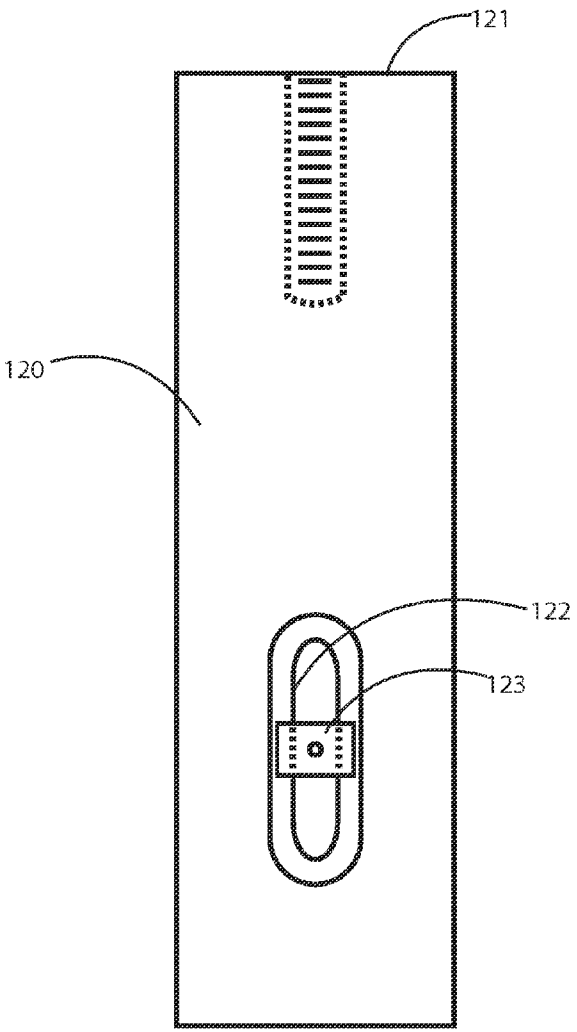
FIG. 6B is a perspective view of the invention, illustrating the tapered shim with an elongated aperture.
Figure 6C:
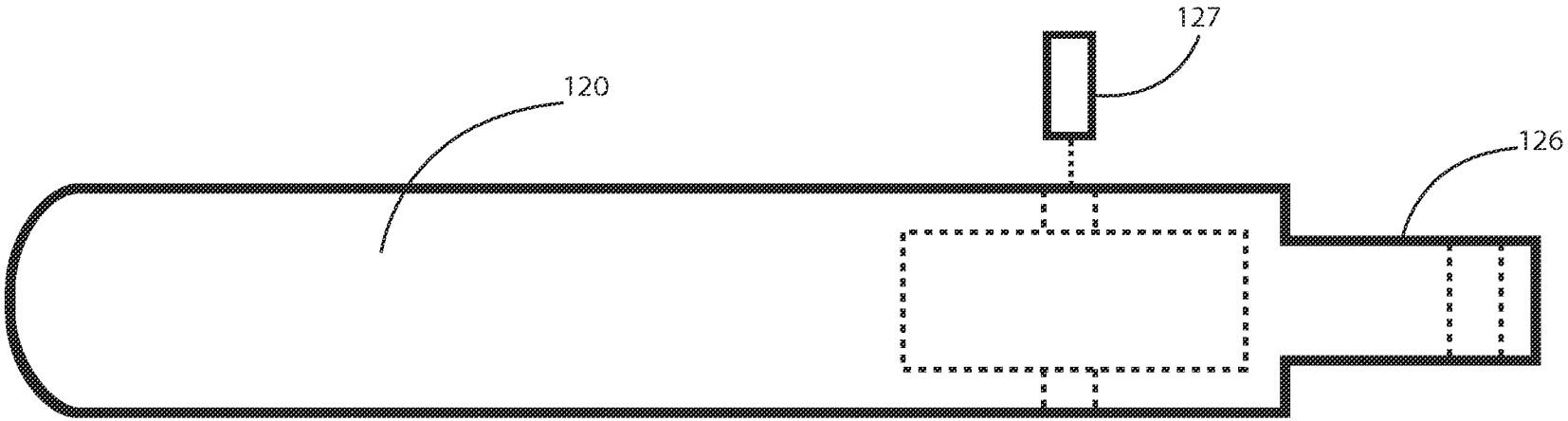
FIG. 6C is another perspective view of the invention, illustrating the tapered shim with a locking pin.

Referring to FIGS. 6A-6C, exploded views of the locking means 100 of the invention are illustrated wherein the locking means 100 includes a handle 125 attached to a tapered shim 120. The tapered shim 120 can be selectively forced between each tongue portion 90 and groove portion 80 for frictionally locking the tongue portion 90 to the groove portion 80. The tapered shim 120 includes an elongated aperture 122 and is slidably held along a substantially vertical plane by a bolt means 123 to one tongue portion 90. Each tapered shim 120 further includes a handle 125 pivotally fixed to the one tongue portion 90 at a pivoted end 126 thereof. The handle 125 can be pivotally fixed to a top portion 121 of the shim 120. The handle 125 can be pivoted between a locked and an unlocked position, the lock position forcing the tapered shim 120 between one of the tongue and groove portions 90 and 80 for frictionally locking the tongue portion 90 to the groove portion 80. The handle 125 is pivotally fixed to the top portion 121 of the shim 120 by a connector 140 that includes an elongated substantially horizontal slot 142 for receiving a locking pin 127 of the handle 125. A threaded aperture 144 can be located on the lower side 145 of the connector 140 that is adapted for receiving a threaded shaft 150 fixed to the top portion 121 of the shim 120 thereof.

Figure 8:
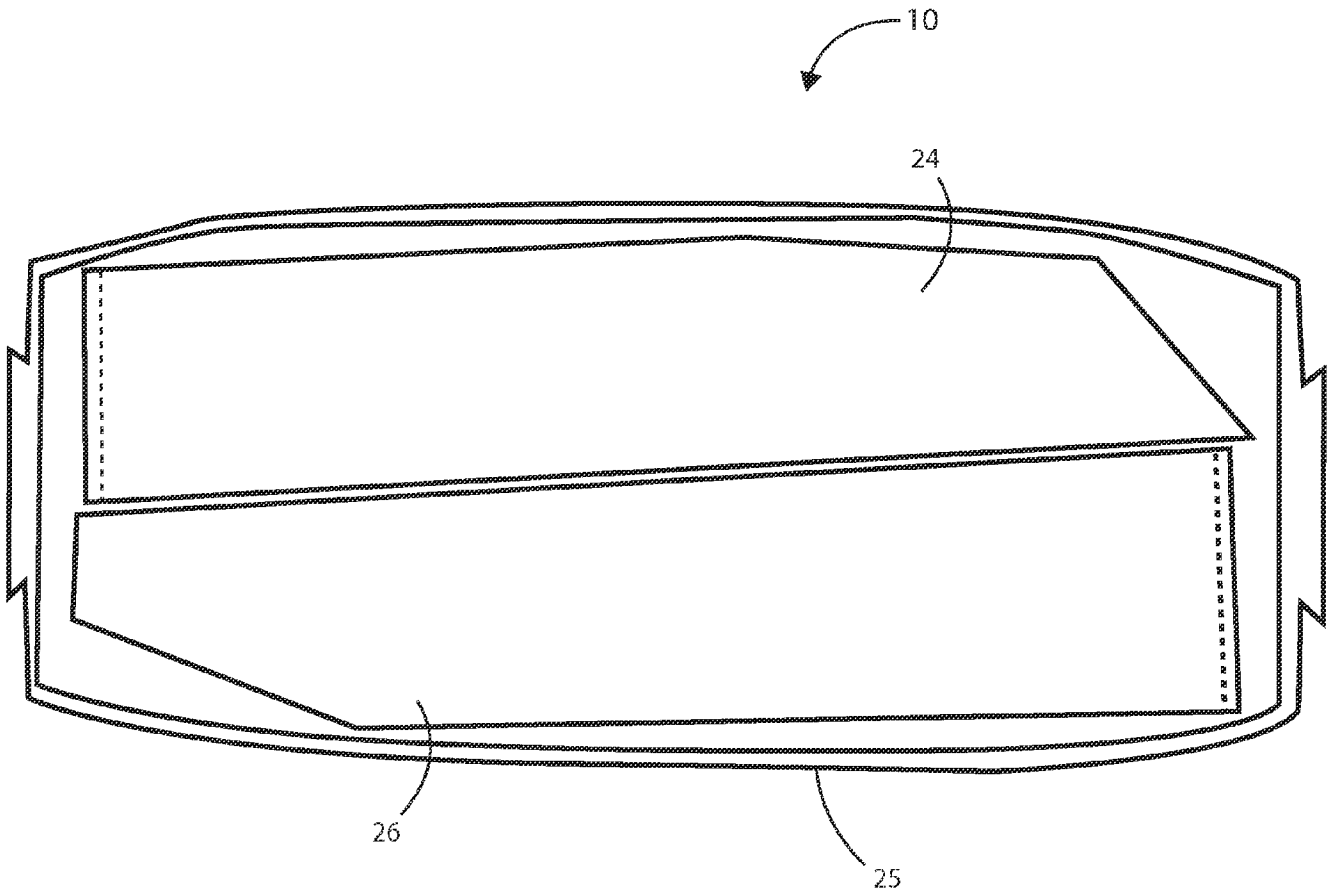
FIG. 8 is a top plan view of the invention, illustrating the hull sections of the multi-part boat nested together in the disassembled configuration.

FIG. 8 illustrates the bow section 24 and the stern section 26 that can at least partially fit within the middle section 25 to form a compact unit for storage and transport when the boat 10 is in a disassembled configuration.

Figure 10:
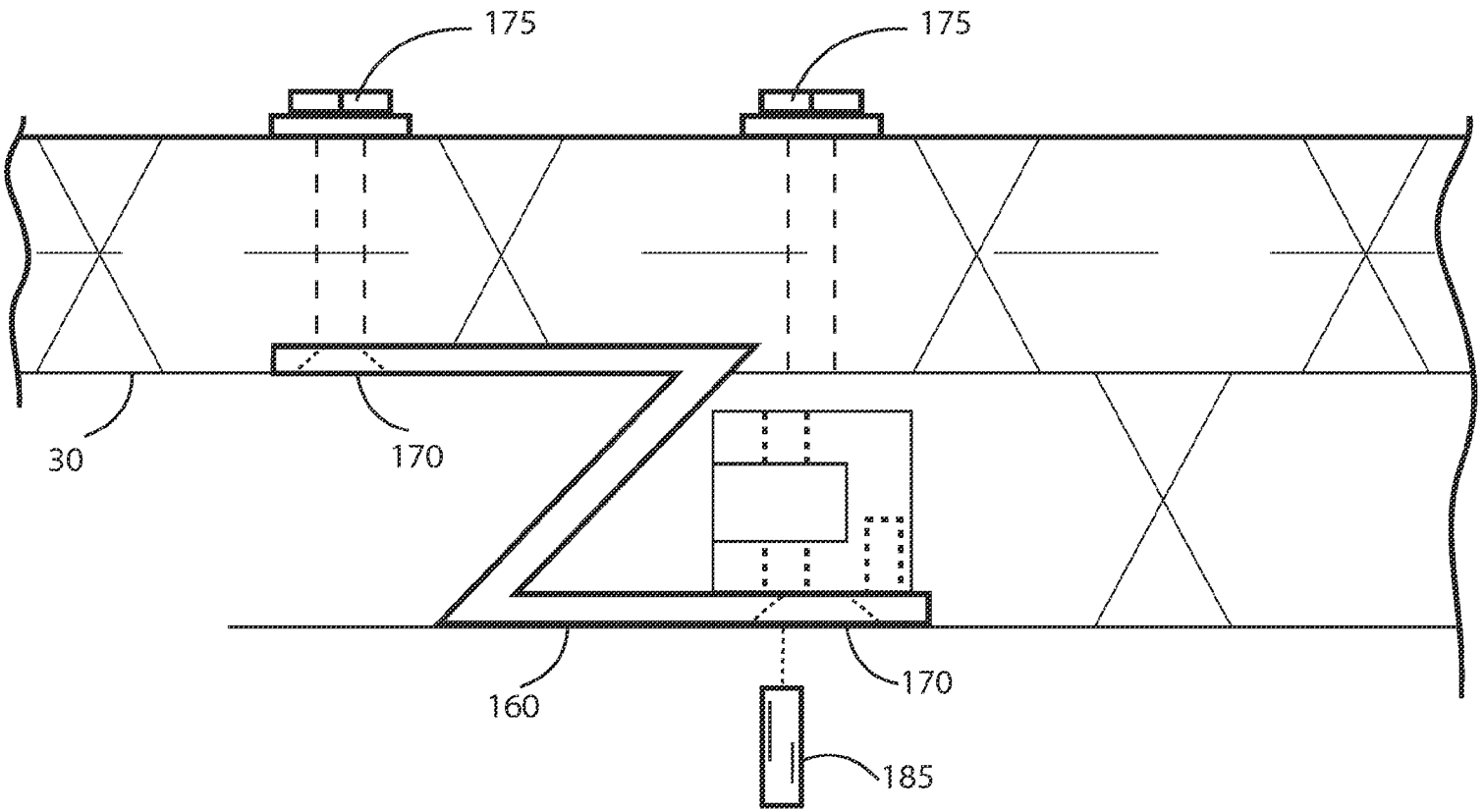
FIG. 10 is an exploded perspective view of the invention, illustrating a reinforcing bracket.
Figure 11:
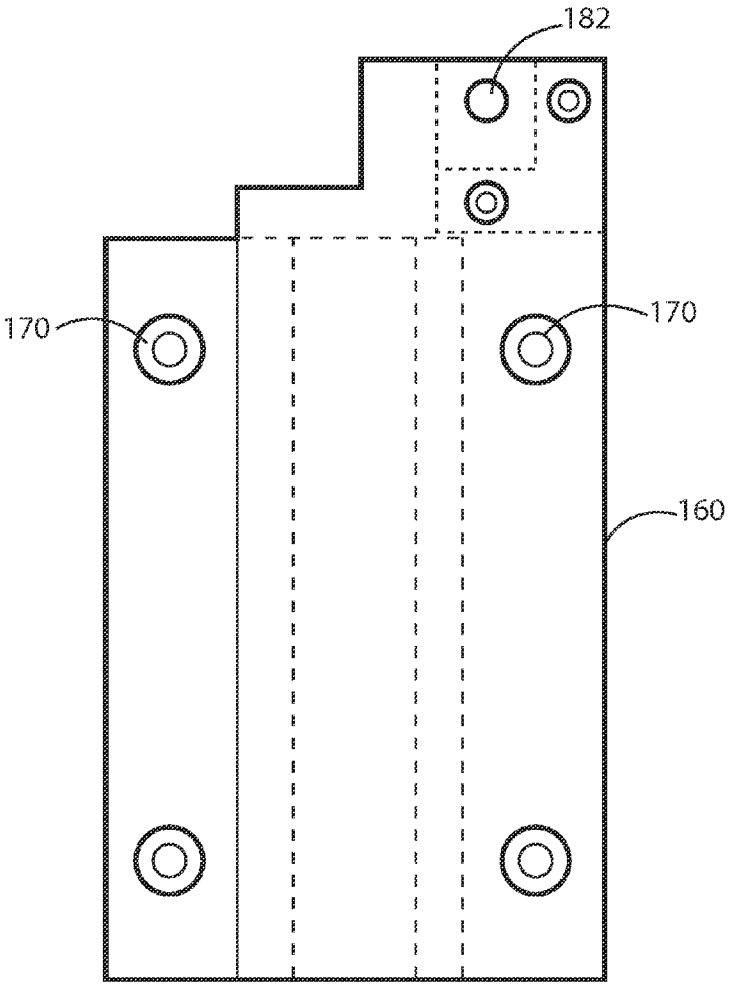
FIG. 11 is a side view of the invention, illustrating the reinforcing bracket.
Figure 12:
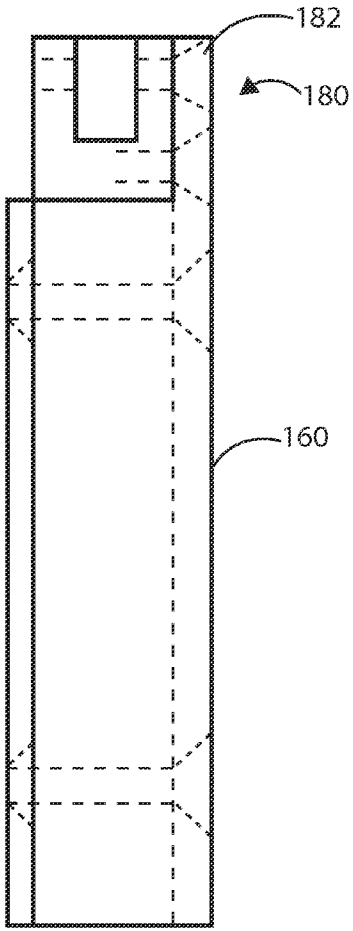
FIG. 12 is another side view of the invention, illustrating the reinforcing bracket.

Referring again to FIG. 9, a perspective view of the invention, the tongue portion 90 and a groove portion 80 are associated with hull sections 20. Referring now to FIGS. 10 through 12, each tongue portion 90 and each groove portion 80 includes a rigid reinforcing bracket 160. The reinforcing bracket 160 includes a mechanical fastener 175 for attaching to the bulkhead side 30 through the aperture 170 in the bulkhead side 30 and the reinforcing bracket 160. Subsequently, the reinforcing bracket 160 can be secured to the bulkhead side 30 via mechanical fastener 175. The reinforcing bracket 160 further includes a lever pivot means 180 whereby the lever 125 (FIG. 7) is pivotally mounted to the boat 10. The lever pivot means 180 is pivotally fixed to the reinforcing bracket 160 by a pivot pin 185 through another aperture 182.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A boat comprising:

a plurality of substantially hollow hull sections, each section having at least one bulkhead side, at least one peripheral side, a bottom side, and a top side, the plurality of hull sections including a bow section, a middle section, and a stern section, the middle section including a forward bulkhead side for attaching to the bow section, a rear bulkhead side for attaching to the stern section, and a substantially open top side;

at least one bulkhead attachment means comprising a groove portion and a tongue portion, each tongue portion for slidable mutual engagement to one of the groove portions, each portion fixed to one of the at least one bulkhead sides of one of the hull sections; one of the tongue portions including a locking means for selectively locking each tongue portion to the groove portion, at least one of the hull sections including a keel on the bottom side thereof that partially overlaps an adjacent hull section when the two hull sections are fixed together by the bulkhead attachment means;

whereby the boat may be assembled by slidably engaging each tongue portion of one of the plurality of hull sections to one of the groove portions of one of the other hull sections and locking each hull section together with the locking means, the keel acting as a stop for preventing slidable engagement of the two hull sections beyond a point of proper coaxial alignment thereof.

2. The boat of claim 1 wherein the adjacent hull section includes a cooperating keel that is shorter than the length of the bottom side thereof by the amount of overlap of the keel of the one hull section, whereby when the two hull sections are fixed together by the bulkhead attachment means the keel of the one hull section becomes co-aligned and abutted with the keel of the adjacent hull section.

3. A boat comprising:

a plurality of substantially hollow hull sections, each section having at least one bulkhead side, at least one peripheral side, a bottom side, and a top side;

at least one bulkhead attachment means comprising a groove portion and a tongue portion, each tongue portion for slidable mutual engagement to one of the groove portions, each portion fixed to one of the at least one bulkhead sides of one of the hull sections; one of the tongue portions including a locking means for selectively locking each tongue portion to the groove portion, the locking means including a tapered shim that may be selectively forced between each tongue and groove portion for frictionally locking the tongue portion to the groove portion;

whereby the boat may be assembled by slidably engaging each tongue portion of one of the plurality of hull sections to one of the groove portions of one of the other hull sections and locking each hull section together with the locking means.

4. The boat of claim 3 wherein each tapered shim includes an elongated aperture and is slidably held along a substantially vertical plane by a bolt means to one tongue portion, and wherein each tapered shim further includes a handle pivotally fixed to the one tongue portion at a pivoted end thereof, the handle pivotally fixed to a top portion of the shim, whereby the handle may be pivoted between a locked and an unlocked position, the lock position forcing the shim between one of the tongue and groove portions for frictionally locking the tongue portion to the groove portion.

* * * * *